US010747147B2

(12) United States Patent
Shimamoto et al.

(10) Patent No.: US 10,747,147 B2
(45) Date of Patent: Aug. 18, 2020

(54) IMAGE FORMING APPARATUS CAPABLE OF REDUCING VELOCITY VARIATIONS OF AN INTERMEDIATE TRANSFER BELT

(71) Applicant: CANON KABUSHIKI KAISHA, Tokyo (JP)

(72) Inventors: Yuri Shimamoto, Toride (JP); Kentaro Yamana, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/588,891

(22) Filed: Sep. 30, 2019

(65) Prior Publication Data

US 2020/0110352 A1 Apr. 9, 2020

(30) Foreign Application Priority Data

Oct. 4, 2018 (JP) ..... 2018-189458

(51) Int. Cl.
*G03G 15/01* (2006.01)
*G03G 15/16* (2006.01)

(52) U.S. Cl.
CPC ..... *G03G 15/1615* (2013.01)

(58) Field of Classification Search
CPC ..... G03G 15/1615
USPC ..... 399/302
See application file for complete search history.

(56) References Cited

U.S. PATENT DOCUMENTS 8,903,289 B2 * 12/2014 Yu et al. ..... G03G 15/1615 399/313

FOREIGN PATENT DOCUMENTS

| | | | |
|---|---|---|---|
| JP | 2007-264292 | A | 10/2007 |
| JP | 2010-54855 | A | 3/2010 |
| JP | 2010-170088 | A | 8/2010 |
| JP | 2012-63565 | A | 3/2012 |

* cited by examiner

*Primary Examiner* — William J Royer
(74) *Attorney, Agent, or Firm* — Canon U.S.A., Inc. IP Division

(57) ABSTRACT

In an image forming apparatus, an inertia roller having a large moment of inertia is arranged between a secondary transfer section and a primary transfer section, and in the neighborhood of the secondary transfer section. This configuration effectively reduces a velocity variation of an endless intermediate transfer belt that occurs when a printing medium enters the secondary transfer portion. Image defects are thus suppressed.

11 Claims, 9 Drawing Sheets

IMAGE FORMING APPARATUS CAPABLE OF REDUCING VELOCITY VARIATIONS OF AN INTERMEDIATE TRANSFER BELT

BACKGROUND OF THE INVENTION

Field of the Invention

The present disclosure relates to an image forming apparatus including an intermediate transfer belt.

Description of the Related Art

In an image forming apparatus including an intermediate transfer belt, a toner image formed in an image forming unit is transferred onto the intermediate transfer belt in a primary transfer section, and the toner image is then transferred onto a printing medium such as paper in a secondary transfer section.

When the printing medium passes through this secondary transfer section, a velocity variation of the intermediate transfer belt may occur. Particularly when thick paper or high-stiffness paper is used as the printing medium or when a printing velocity is high, such a velocity variation is large. This velocity variation affects an image on the intermediate transfer belt that has been primarily transferred and an image on a photoconductor drum. An image detect such as a streaky image blur (hereinafter referred to as "shock") running in a widthwise direction of the intermediate transfer belt or a color misalignment occurs as a result.

Conventional techniques for solving this inconvenience include Japanese Patent Application Laid-Open No. 2007-264292, which discusses a configuration including a rotation inertia control unit coaxially coupled with a driven roller that stretches an intermediate transfer belt. The inertia of the rotation inertia control unit prevents an impact of entry of a printing medium from being transmitted to a primary transfer section. A velocity variation of the intermediate transfer belt is thus reduced, whereby image defects are controlled.

In Japanese Patent Application Laid-Open 2007-264292, the rotation inertia control unit is coupled with the driven roller that stretches the intermediate transfer belt, and the inertia of the rotation inertia control unit prevents transmission of a velocity variation. However, it has been found that the efficiency of velocity variation reduction is lowered depending on the position of the driven roller with which the rotation inertia control unit is coupled.

SUMMARY OF THE INVENTION

The present disclosure is directed to an image forming apparatus for efficiently reducing velocity variations of an endless intermediate transfer belt that occurs when a printing medium enters a secondary transfer portion.

An image forming apparatus of the present disclosure includes an image forming unit configured to form an image, an endless intermediate transfer belt, wherein an image formed in the image forming unit is to be primary transferred onto the endless intermediate transfer belt at a primary transfer portion and the image is to be secondary transferred from the endless intermediate transfer belt onto a recording material at a secondary transfer portion, a transfer roller configured to contact an inner side of the endless intermediate transfer belt and to stretch the endless intermediate transfer belt at the secondary transfer portion, a first roller configured to contact the inner side of the endless intermediate transfer belt and to stretch the endless intermediate transfer belt in a position downstream of the primary transfer portion and upstream of the secondary transfer portion in a moving direction of the endless intermediate transfer belt, and a second roller configured to contact the inner side of the endless intermediate transfer belt and to stretch the endless intermediate transfer belt in a position downstream of the first roller and upstream of the secondary transfer portion in the moving direction of the endless intermediate transfer belt. The first roller has the largest wrap angle of the endless intermediate transfer belt among rollers stretching the endless intermediate transfer belt in a region downstream of the primary transfer portion and upstream of the secondary transfer portion in the moving direction of the endless intermediate transfer belt. $L_1/L_2<½$ with $L_1$ denoting a length of a portion of the endless intermediate transfer belt that is stretched between the secondary transfer inner roller and the second roller and $L_2$ denoting a length of a portion of the endless intermediate transfer belt that is stretched between the transfer roller and the first roller. The second roller has a moment of inertia of 30 $kgmm^2$ or more and 1500 $kgmm^2$ or less.

Further features of the present disclosure will become apparent from the following description of exemplary embodiments with reference to the attached drawings.

DESCRIPTION OF THE EMBODIMENTS

Figure 1:
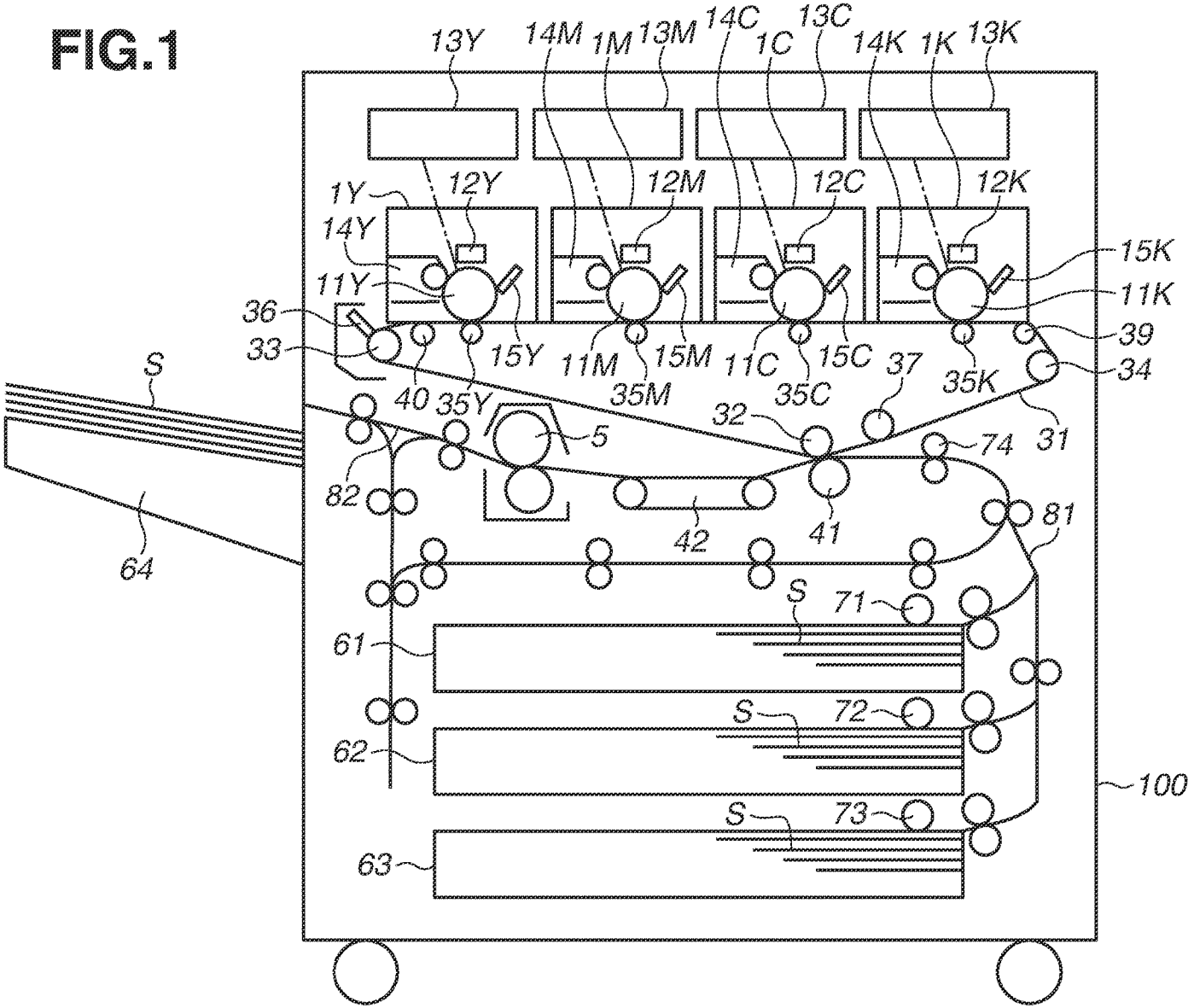
FIG. 1 is a schematic configuration view of an image forming apparatus.

Exemplary embodiments according to the present disclosure are described below based on the drawings. The following description on specifications such as dimensions of, materials of, and relative positions between constituent components of an image forming apparatus is not intended to limit the scope of the present disclosure to those specifications unless otherwise particularly stated. Constituent elements assigned the same reference numerals in the drawings are the same constituent element or those that have the same function. Descriptions thereof are therefore omitted as appropriate.

[Image Forming Apparatus]

FIG. 1 is a schematic configuration view illustrating an image forming apparatus 100 according to the present exemplary embodiments as a sectional view.

This image forming apparatus 100 is an image forming apparatus adopting a tandem intermediate transfer system, and has image forming units 1Y, 1M, 1C, and 1K arranged in line along a horizontal portion of an intermediate transfer belt 31. The image forming apparatus 100 forms a full-color image on a printing medium S by electrophotography based on image signals transmitted from an external device.

The image forming units 1Y, 1M, 1C, and 1K form toner images of different colors of yellow, magenta, cyan, and black on photoconductor drums 11Y, 11M, 11C, and 11K, respectively, and primarily transfers the toner images on the same image position on the intermediate transfer belt 31.

Around the photoconductor drum 11Y on which a yellow toner image is formed, an electrostatic charger 12Y, an exposure device 13Y, a developer 14Y, and a cleaning device 15Y are arranged. The electrostatic charger 12Y uniformly electrostatically charges a surface of the photoconductor drum 11Y. The exposure device 13Y irradiates the photoconductor drum 11Y with light to form a latent image on the surface thereof. The developer 14Y transfers toner onto the latent image formed on the photoconductor drum 11Y to develop a toner image thereon. The cleaning device 15Y removes toner remaining on the photoconductor drum 11Y after the toner image is primarily transferred. Configurations for forming toner images of magenta, cyan, and black can be understood by replacing the suffix Y in the above description with M, C, and K, respectively.

The intermediate transfer belt 31 is an endless belt stretched by a plurality of rollers and configured to rotate by having any of those rollers driven. Primary transfer rollers 35Y, 35M, 35C, and 35K for carrying out the primary transfer are arranged facing an inner circumferential surface of the intermediate transfer belt 31 in respective positions opposite to the photoconductor drums 11Y, 11M, 11C, and 11K, and form a primary transfer section.

A printing medium S stored in a sheet cassette 61, 62, or 63 is conveyed to a feed conveyance path 81 by rotation of a corresponding sheet feed roller 71, 72, or 73. A pair of registration rollers 74 feed the printing medium S into a secondary transfer section in synchronization with the timing of delivery thereto of a toner image on the intermediate transfer belt 31. The secondary transfer section is formed by contact made by a secondary transfer member 41 and a secondary transfer inner roller 32. The secondary transfer section forms the toner image on the printing medium S. A cleaning device 36 removes transfer residual toner remaining on the intermediate transfer belt 31 after secondary transfer.

The printing medium S having the toner image transferred thereon is conveyed to a heat fixing device 5 by a conveyance belt 42. The heat fixing device 5 applies heat and pressure to the printing medium S to firmly attach the toner image to a surface of the printing medium 5, thereby fixing a full-color image. Thereafter, the printing medium S passes through a discharge conveyance path 82 to be delivered onto an output tray 64.

[Configuration for Stretching Intermediate Transfer Belt]

Figure 2:
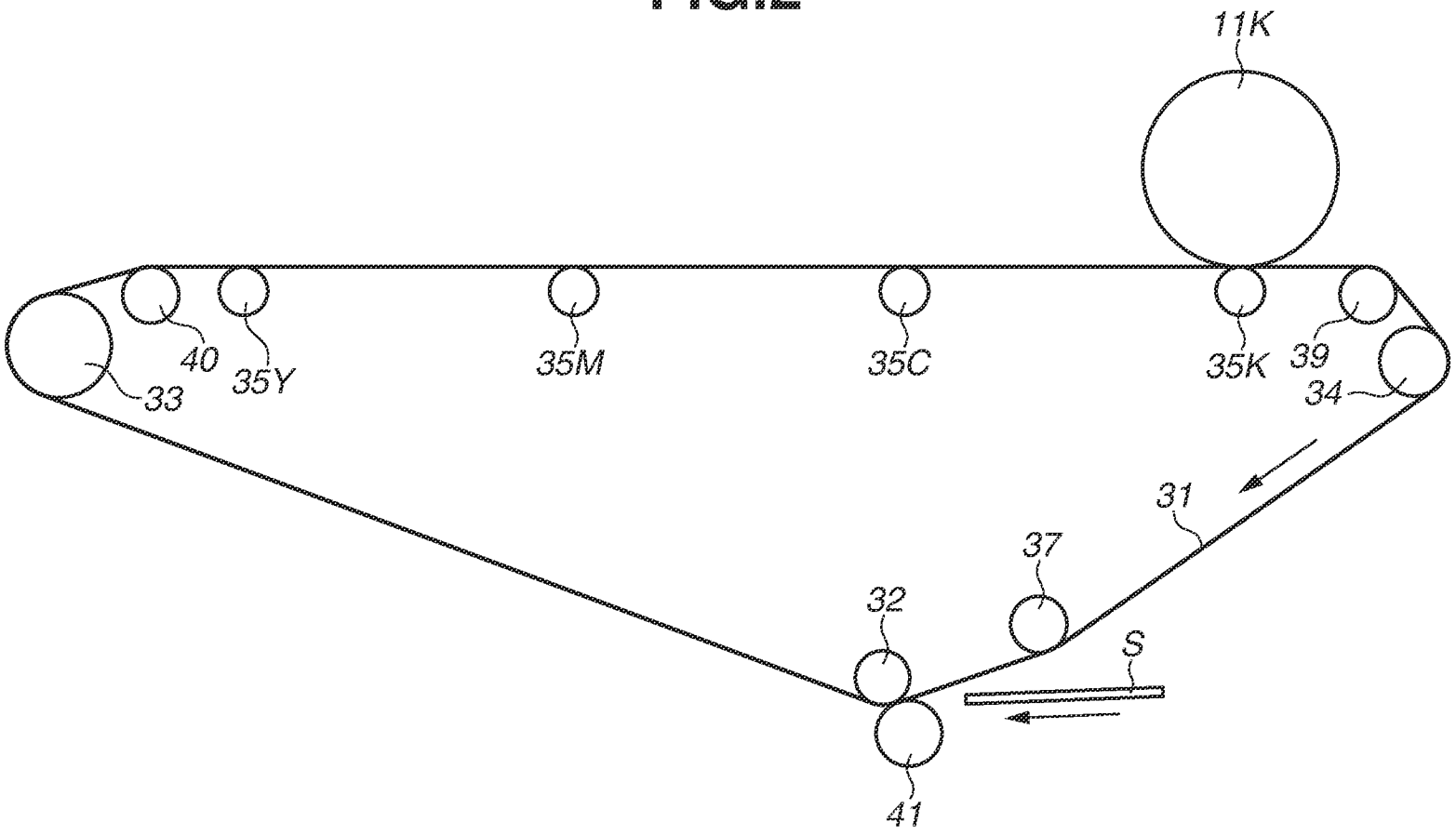
FIG. 2 is a schematic configuration view of the surroundings of an intermediate transfer belt.

FIG. 2 is a schematic configuration view of the surroundings of the intermediate transfer belt 31.

The intermediate transfer belt 31 is stretched by a plurality of stretching rollers. A driving roller 33, which is provided as one of the stretching rollers and as an upstream stretching roller, is arranged in a region upstream of the primary transfer section and downstream of the secondary transfer section with respect to a moving direction of the intermediate transfer belt 31, and stretches the intermediate transfer belt 31.

A tension roller 34, which is provided as one of the stretching rollers and as a downstream stretching roller, is arranged in a region downstream of the primary transfer section and upstream of the secondary transfer section with respect to the moving direction of the intermediate transfer belt 31. The tension roller 34 is pressed by a spring toward the inner surface of the intermediate transfer belt 31 and applies tension to the intermediate transfer belt 31. The secondary transfer inner roller 32 stretches the intermediate transfer belt 31 and forms the secondary transfer section.

FIG. 2 illustrates a first driven roller 37, a second driven roller 39, and a third driven roller 40 arranged in addition to the above rollers. The first driven roller 37 is arranged upstream of and adjacent to the secondary transfer inner roller 32 to form a secondary transfer upstream surface together with the secondary transfer inner roller 32. The second driven roller 39 and the third driven roller 40 are arranged downstream and upstream, respectively, of and adjacent to the primary transfer section to stretch a belt surface in the primary transfer section into a planar state.

These rollers are provided mainly for the purpose of stretching intermediate transfer belt 31. Therefore, relatively lightweight rollers such as aluminum three-arrow-shaped tubes are typically used as these rollers.

The above positions of the driven rollers are an example. This example is not intended to limit the driven rollers to the above positions and is not intended to limit number of such rollers.

[Phenomenon Occurring when Printing Medium Enters Secondary Transfer Section]

Figure 3:
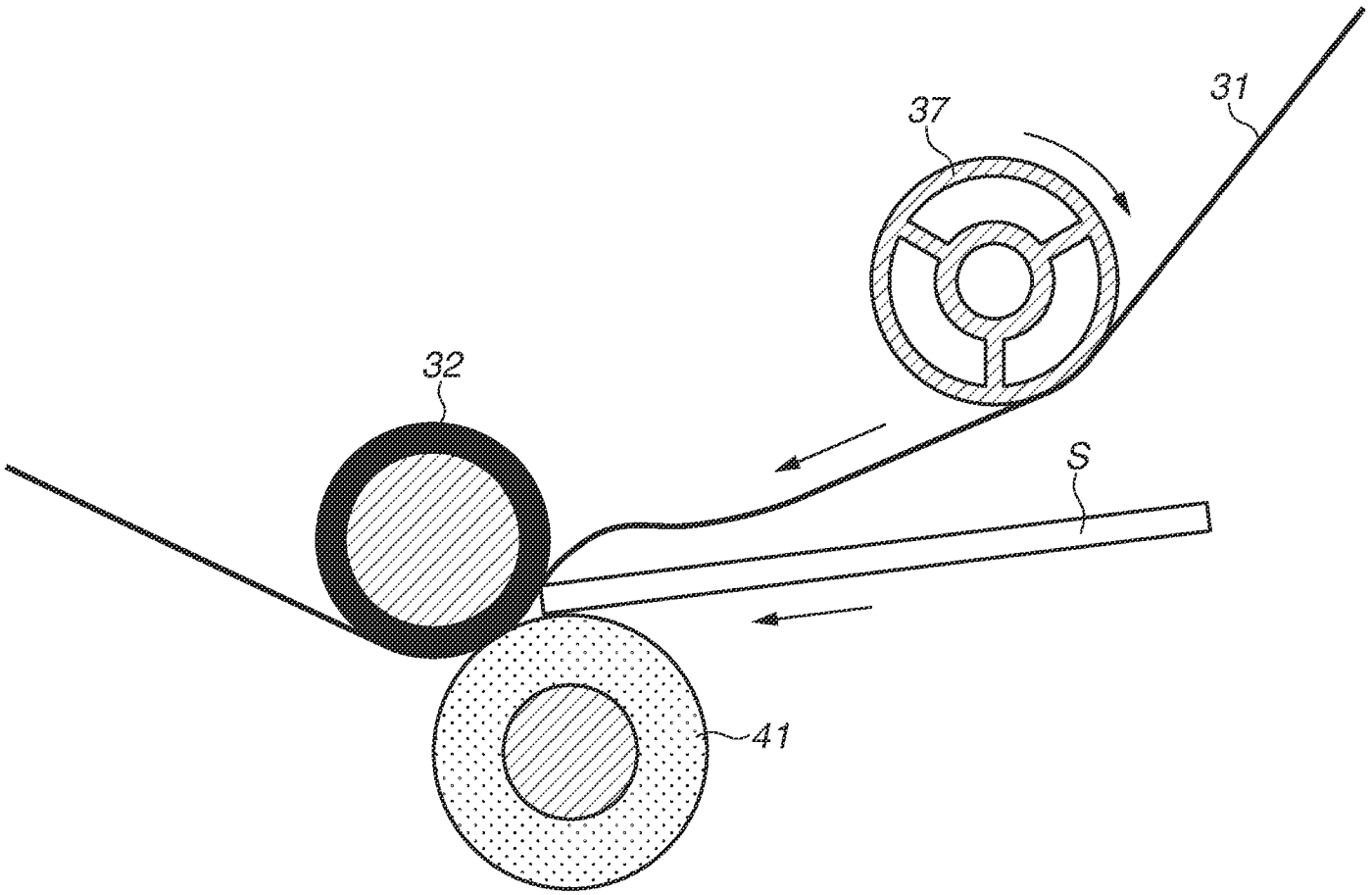
FIG. 3 is a schematic configuration view describing a phenomenon that occurs when a printing medium makes contact with the intermediate transfer belt.

With reference to FIG. 3, movements that the intermediate transfer belt 31 makes when the printing medium S enters the secondary transfer section and how such movements affect an image are described. FIG. 3 is a schematic configuration view of the secondary transfer section at a moment when the leading edge of the printing medium S makes contact with the intermediate transfer belt 31 after the printing medium S has been fed to the secondary transfer section.

At this moment, the intermediate transfer belt 31 is pushed in toward the inner circumference side of the intermediate transfer belt 31, and the first driven roller 37 is accelerated by receiving a force in its rotating direction due to a frictional force that acts between the first driven roller 37 and the intermediate transfer belt 31. As a result of the acceleration of the first driven roller 37, a curvature occurs in the stretched belt surface between the secondary transfer inner roller 32 and the first driven roller 37. This curvature disappears as the printing medium S travels further forward thereafter.

The occurrence and disappearance of this belt curvature generates velocity variations of the intermediate transfer belt 31. These velocity variations are transmitted to the secondary transfer section and to the primary transfer section. As a result, images are blurred in the primary transfer section and on the photoconductor drum, resulting in occurrence of image defects.

Particularly when the printing medium S has a higher grammage or higher stiffness or when the printing velocity is higher, the belt curvature becomes larger and the velocity variations therefore become larger, making image defects more likely to occur.

In a first exemplary embodiment, an inertia roller 38 is provided so that a curvature can be prevented from occurring in the intermediate transfer belt 31 when the printing medium S as described above enters the secondary transfer section. Specifically, the position in which the inertia roller 38 is arranged is set downstream of a downstream stretching roller and upstream of the secondary transfer section in the conveyance direction of the intermediate transfer belt 31. In the present exemplary embodiment, the downstream stretching roller means a roller having the largest wrap angle of the intermediate transfer belt 31 among rollers that stretch the intermediate transfer belt 31 in a region downstream of the primary transfer section and upstream of the secondary transfer section in the moving direction of the intermediate transfer belt 31. In the present exemplary embodiment, the downstream stretching roller is the tension roller 34. Further, the inertia roller 38 is arranged in a position relatively close to the secondary transfer section between the tension roller 34 serving as the downstream stretching roller and the secondary transfer inner roller 32. This arrangement can effectively prevent occurrence of the above-described curvature in the intermediate transfer belt 31, whereby belt velocity variations can be effectively reduced.

Figure 4:
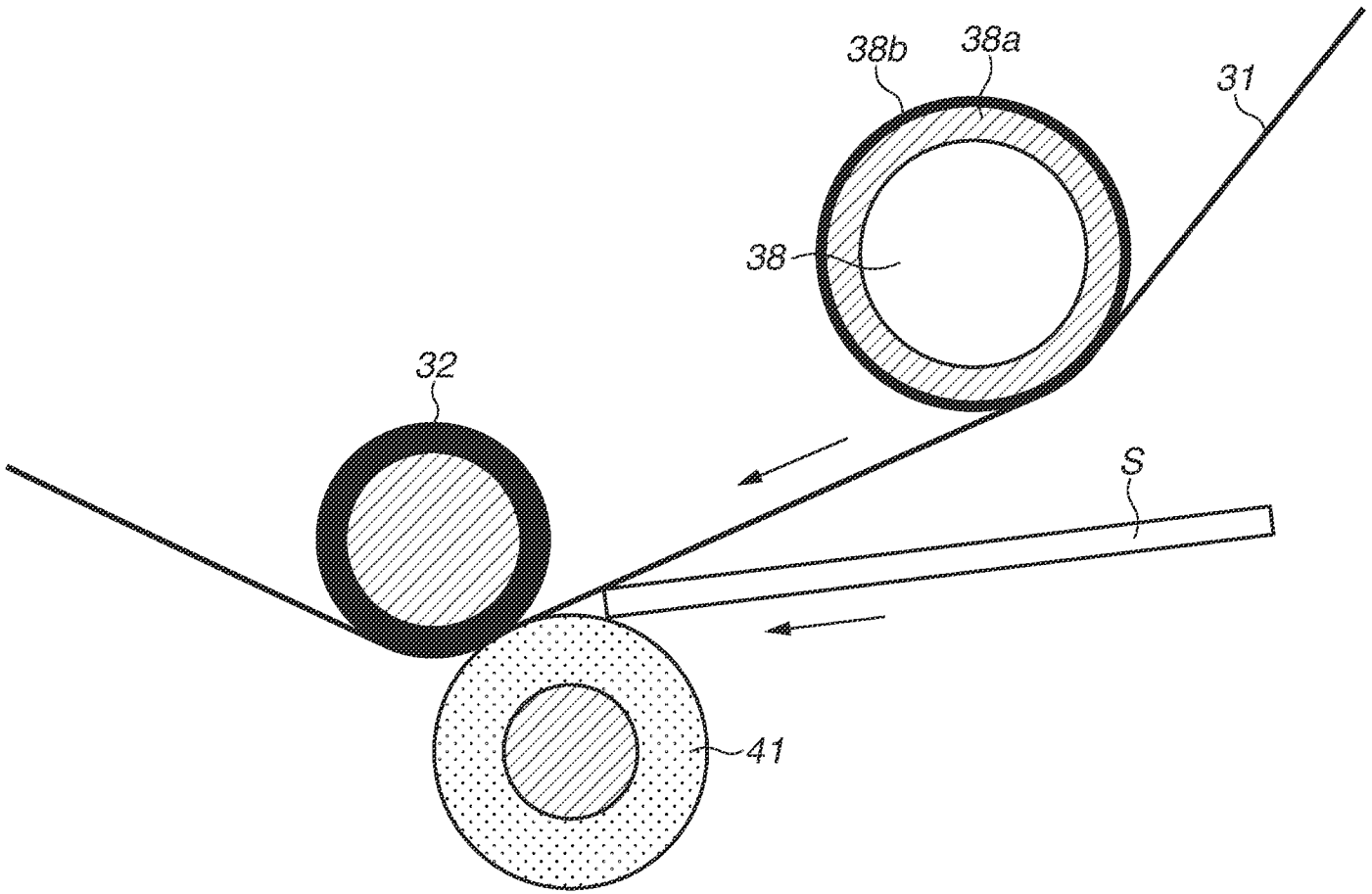
FIG. 4 is a schematic configuration view of a first exemplary embodiment.

FIG. 4 illustratively depicts a first exemplary embodiment of the present disclosure. As described above, in the present application, the inertia roller 38 that is cylindrical is arranged in place of the first driven roller 37 so that the intermediate transfer belt 31 can be prevented from curving when the printing medium S enters the secondary transfer section.

Figure 5:
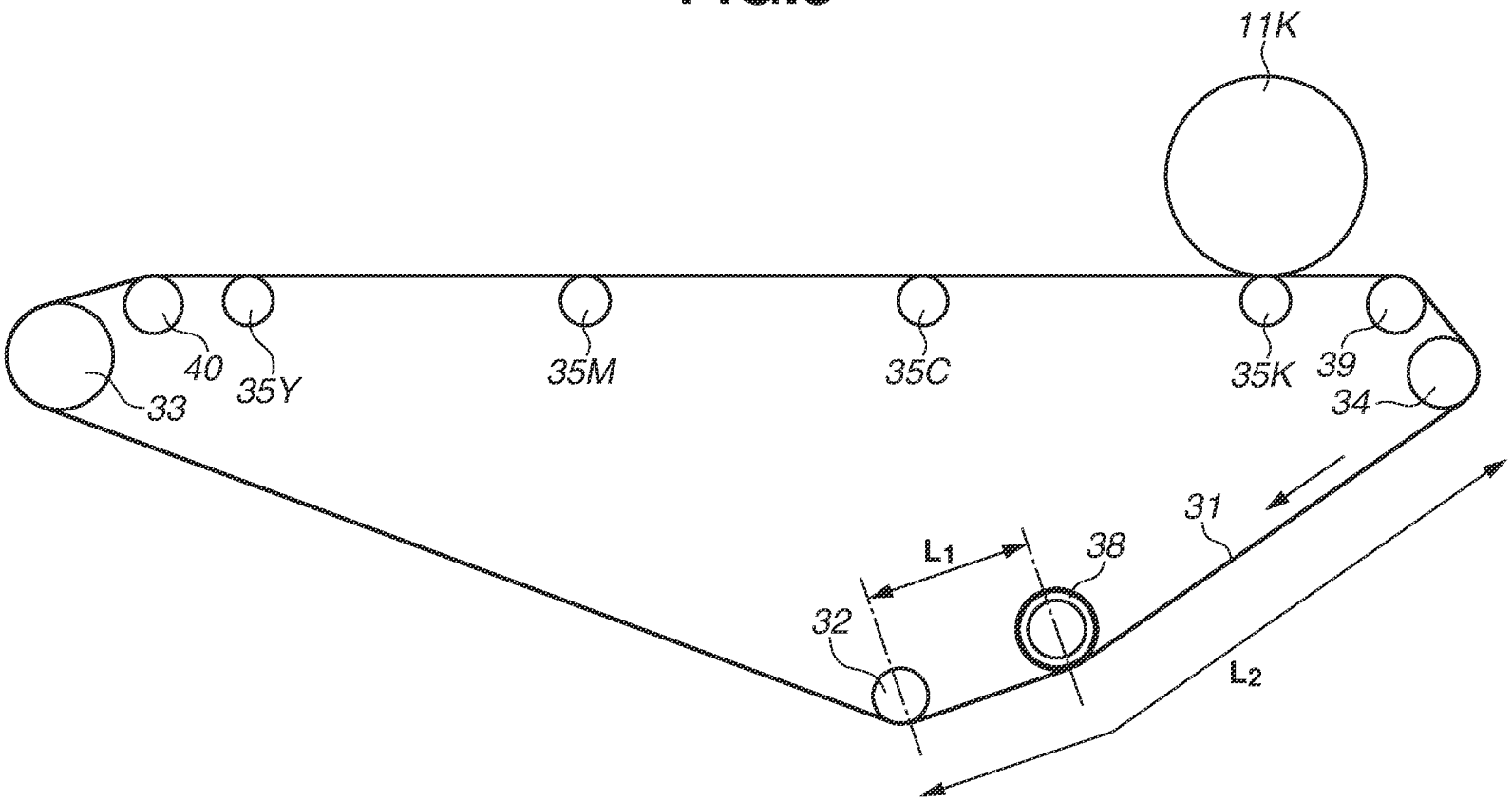
FIG. 5 is a schematic configuration view describing an arrangement of an inertia roller according to the present disclosure.

FIG. 5 illustrates the arrangement of the inertia roller 38. In the present exemplary embodiment, the position of the inertia roller 38 is determined on the basis of the downstream stretching roller that is defined as described above. That is, the length of a portion of the intermediate transfer belt 31 that is stretched between the inertia roller 38 and the secondary transfer inner roller 32 is denoted by $L_1$. The length of a portion of the intermediate transfer belt 31 that is stretched between the secondary transfer inner roller 32 and the tension roller 34 serving as the downstream stretching roller is denoted by $L_2$. More specifically, the length $L_1$ is the length of a portion of the intermediate transfer belt 31 that is stretched, in the moving direction of the intermediate transfer belt 31, from an upstream end of the secondary transfer section to a downstream end of an area through which the inertia roller 38 and the intermediate transfer belt 31 makes contact. The length $L_2$ is the length of a portion of the intermediate transfer belt 31 that is stretched, in the moving direction of the intermediate transfer belt 31, from the upstream end of the secondary transfer section to the downstream end of an area through which the tension roller 34 and the intermediate transfer belt 31 makes contact. As described below, in the present exemplary embodiment, the inertia roller 38 is arranged so that $L_1/L_2<1/2$ can be satisfied.

The inertia roller 38 has a larger moment of inertia than the other driven rollers. That is, the inertia roller 38 has the highest moment of inertia among all of the driven rollers other than the driving roller 33. Thus, the inertia roller 38 is made unlikely to accelerate even with a force larger than a normal level applied thereto by the intermediate transfer belt 31 when the intermediate transfer belt 31 is pushed inward by the printing medium S. Thus, the intermediate transfer belt 31 can continue to stably rotate, whereby an image forming apparatus for preventing an image defect from occurring can be provided.

The moment J of inertia of a cylindrical rotation member is expressed by formula (1) given below:

$$J=\pi\rho L\times(D^4-d^4)/32 \quad (1)$$

In formula (1), ρ denotes the density of a rotation member, L denotes the length of the rotation member in an axial direction thereof, D denotes an outside diameter of the cylinder, and d denotes an inside diameter of the cylinder. Formula (1) suggests that, to make the moment of inertia of the inertia roller 38 larger, the inertia roller 38 needs to be heavier and have a larger outer diameter.

While the outer diameter is particularly dominant, the present exemplary embodiment adopts, for example, the following configuration to avoid being unnecessarily heavyweight:

$\rho=7850\ kg/m^3$ $L=364$ mm $D=30$ mm $d=19.8$ mm.

In other words, the inertia roller 38 includes a base member 38*a* that is a cylindrical hollow tube made of iron. The inertia roller 38 is configured to have a moment J of inertia of 184 $kgmm^2$.

Further, an elastic layer (high-friction layer) is provided on the outer surface of the inertia roller 38 to prevent the inertia roller 38 from slipping on the intermediate transfer belt 31. That is, an urethane coating 38*b* having a thickness of about 30 μm is provided on the surface of the inertia roller 38. In the present exemplary embodiment, the outer surface of the inertia roller 38 is configured to have a static friction coefficient of 0.4 or more against the inner surface of the intermediate transfer belt. This configuration can enhance an effect of reducing velocity variations of the intermediate transfer belt 31 that the inertia roller 38 exhibits.

The form of the inertia roller 38 can be solid, and a measure such as wrapping ethylene propylene diene monomer (EPDM) rubber around the outer surface of the inertia roller 38 can be used to provide the high-friction layer.

Figure 6:
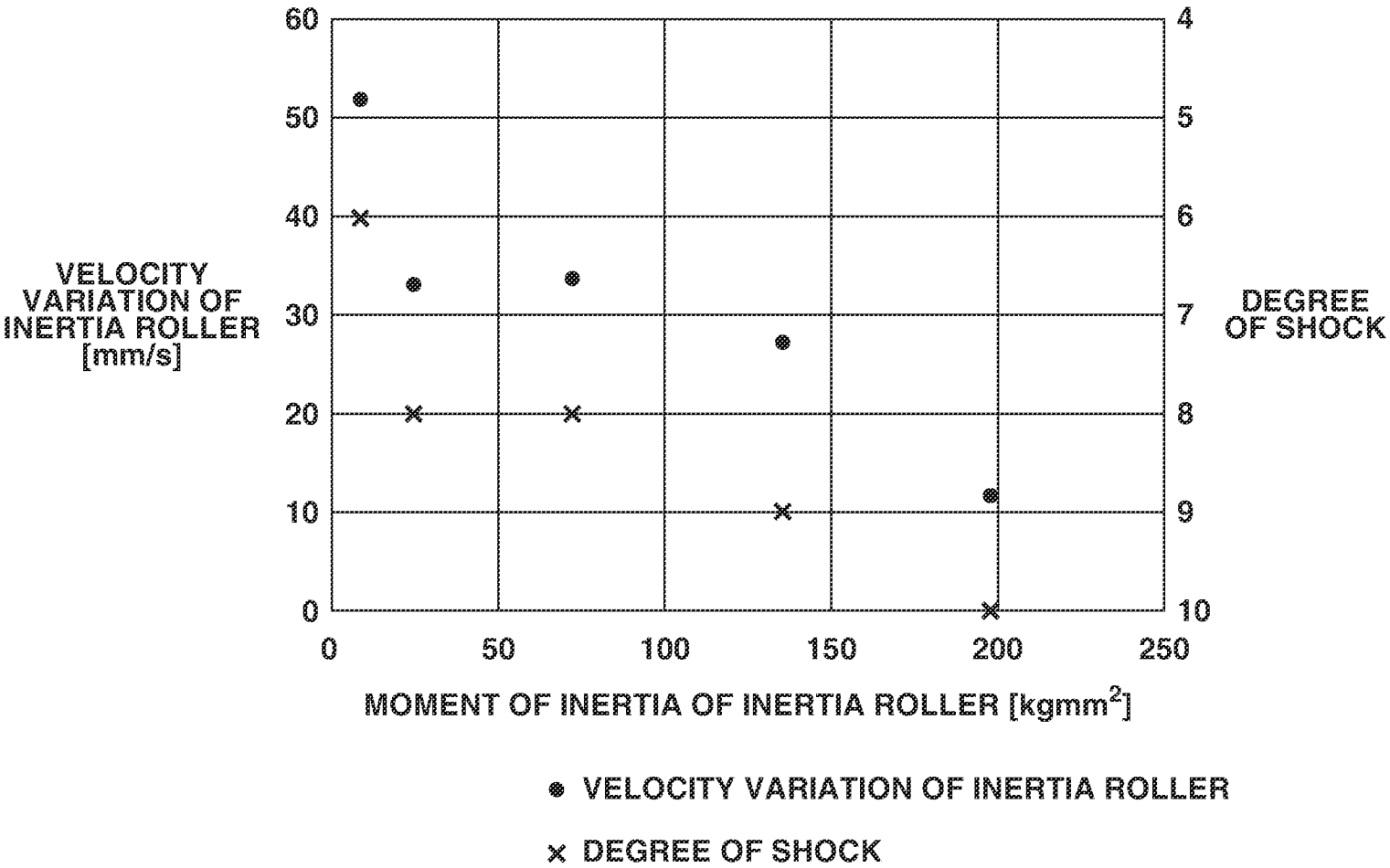
FIG. 6 is a graph representing a relationship among a moment of inertia, velocity variations of the inertia roller, and shocks.

FIG. 6 illustrates a graph representing a relationship among the moment of inertia of the inertia roller 38, the velocity variation thereof that occurs when the printing medium S (high-stiffness paper having a grammage of 350 gsm) enters the secondary transfer section, and a degree of shock (degree of image defect) observed in a product, provided that $L_1=0.26\ L_2$.

The degree of shock is assessed by visual observation using a 10-point scale from 1 to 10 points. A smaller number indicates a higher degree of image defect with 10 indicating a state in which no image defect is observed. The points of 8 and higher indicate states in which image defects are able to be suppressed.

It can be found in FIG. 6 that a larger moment of inertia results in further reduction in velocity variation and consequently in further suppression of shocks. In addition, it can be found that the moment of inertia of 30 $kgmm^2$ or more produces the effect of suppressing shocks.

Figure 7:
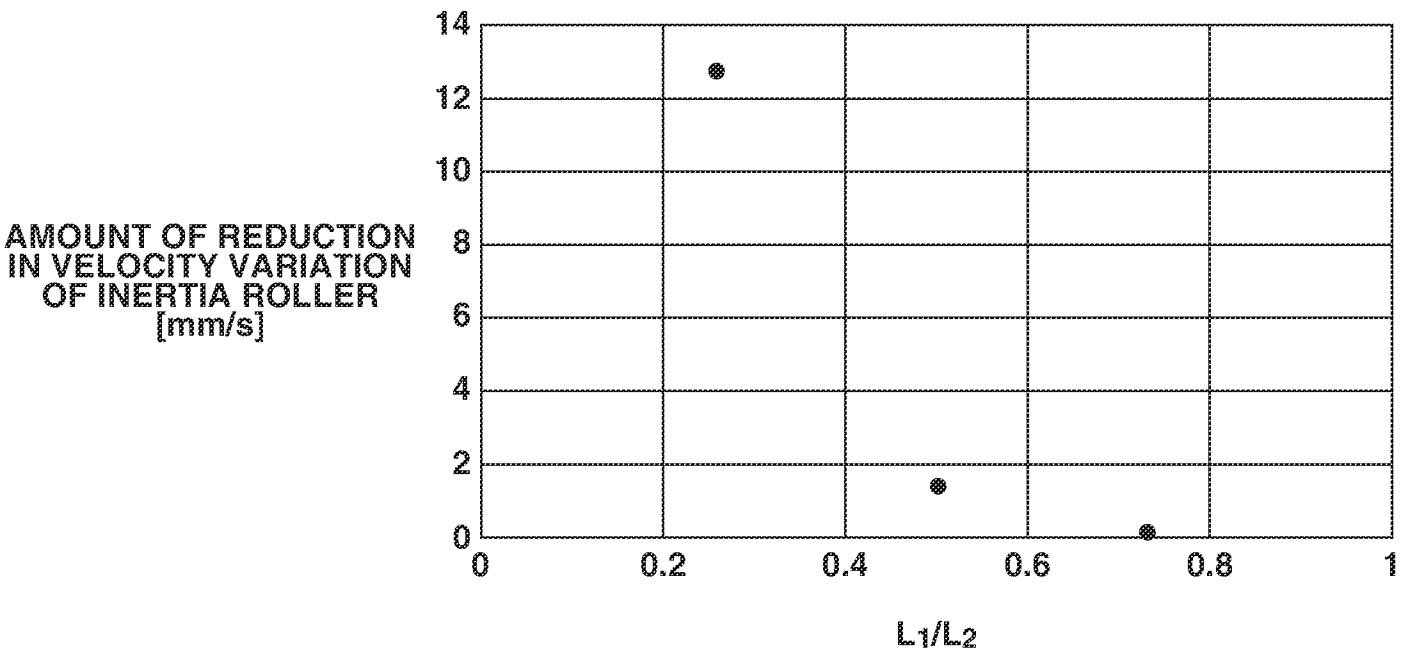
FIG. 7 is a graph representing a relationship between the arrangement of the inertia roller and amounts of reduction in velocity variations thereof.

FIG. 7 is a graph representing a relationship between the arrangement ($L_1/L_2$) of the inertia roller and amounts of reduction in velocity variation thereof. The vertical axis in FIG. 7 indicates the difference between a velocity variation of the inertia roller 38 that has a moment of inertia of 21 $kgmm^2$ and a velocity variation of the inertia roller 38 that has a moment of inertia of 100 $kgmm^2$. That is, the vertical axis indicates the amount of reduction in velocity variation obtained when the moment of inertia is increased from 21 $kgmm^2$ to 100 $kgmm^2$. The horizontal axis in FIG. 7 indicates $L_1/L_2$. The $L_2$ is constant, a moving velocity of the intermediate transfer belt 31 is set to 174 mm/s, and the printing medium S is high-stiffness paper having a grammage of 350 gsm. The length $L_2$ in this case is 230 mm.

FIG. 7 suggests that the effect of reducing a velocity variation attributable to the increase in moment of inertia of the inertia roller 38 is higher when $L_1/L_2$ is smaller. This is considered because the inertia roller 38 functions as a damper against the intermediate transfer belt 31. Such a damper provides a resistance force proportional to the velocity. It is accordingly considered that a velocity variation can be further reduced by arranging the inertia roller 38 in a position relatively close to the secondary transfer inner roller 32, namely, a position that gives a smaller value to $L_1/L_2$, where a relatively large velocity variation occurs. Therefore, the present exemplary embodiment adopts a condition $0<L_1<120$ mm. A condition $0<L_1<100$ mm is more beneficial.

Reductions in velocity variation can be observed when $L_1/L_2<1/2$, and a sufficient effect of reducing velocity variations can be observed when a condition $L_1/L_2<2/5$ is satisfied. Particularly when a condition $L_1/L_2<1/3$ is satisfied, a high effect of reducing velocity variations can be observed.

FIGS. 6 and 7 suggest that the inertia roller 38 desirably has a moment of inertia of 30 $kgmm^2$ or more and 1500 $kgmm^2$ or less and satisfies the condition $L_1/L_2<1/2$. More beneficially, the inertia roller 38 has a moment of inertia of 50 $kgmm^2$ or more and 1000 $kgmm^2$ or less. The position of the inertia roller 38 beneficially satisfies the condition $L_1/L_2<1/3$ to enable efficient suppression of image defects. In the present exemplary embodiment, the moment of inertia is increased in such a manner that the moment of inertia of the inertia roller 38 itself is increased without attaching a flywheel thereto. Thus, the ease of assembly is enhanced, and the apparatus can be less complicated. That is, in the present exemplary embodiment, the inertia roller 38 is configured in such a manner that a portion thereof positioned inside of the intermediate transfer belt 31 in a rotational axis direction of the inertia roller 38 has a moment of inertia of 30 $kgmm^2$ or more and 1500 $kgmm^2$ or less. The length L of a rotation member of the inertia roller 38 in the axial direction thereof in the present exemplary embodiment is the length of a roller part in the axial direction thereof. The roller part is a portion of the inertia roller 38 that has a cylindrical surface in contact with the intermediate transfer belt 31. That is, the length L excludes axis parts at opposite ends of the inertia roller 38. In the present exemplary embodiment, the width of the intermediate transfer belt 31 is 360 mm, so that, in the present exemplary embodiment, the length of the roller part of the inertia roller 38 is configured to be shorter than the width of the intermediate transfer belt 31.

Figure 8:
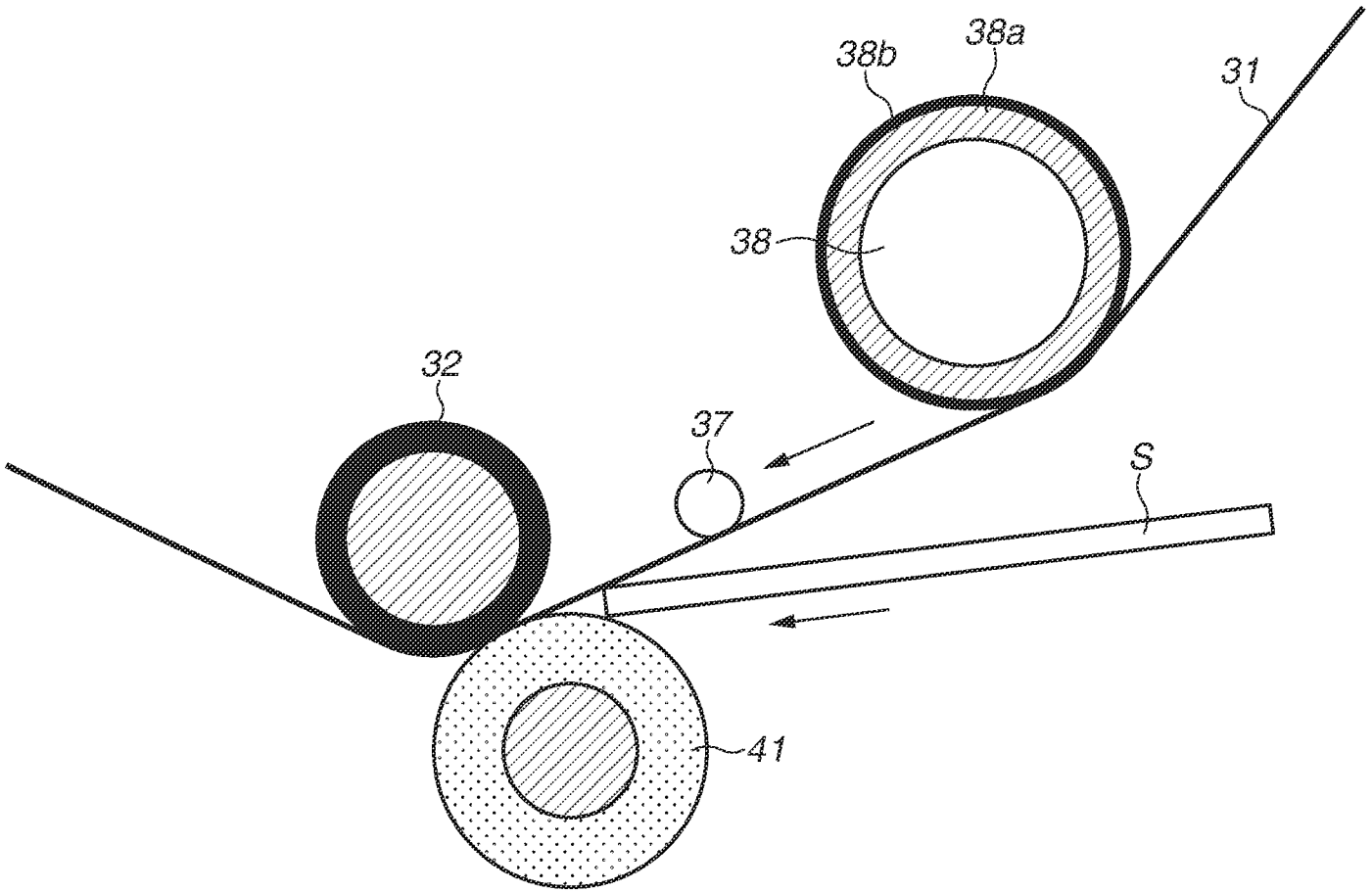
FIG. 8 is a schematic configuration view of a second exemplary embodiment.

FIG. 8 illustratively depicts a second exemplary embodiment of the present disclosure.

The difference between the first and the second exemplary embodiments is that the first driven roller 37 is disposed between the secondary transfer inner roller 32 and the inertia roller 38 in the second exemplary embodiment. This first driven roller 37 has an effect of increasing a contact area between the printing medium S and the intermediate transfer belt 31.

Provided that an arrangement relationship specified in the first exemplary embodiment is satisfied, another roller can be disposed between the secondary transfer inner roller 32 and the inertia roller 38 as described in the second exemplary embodiment.

Figure 9:
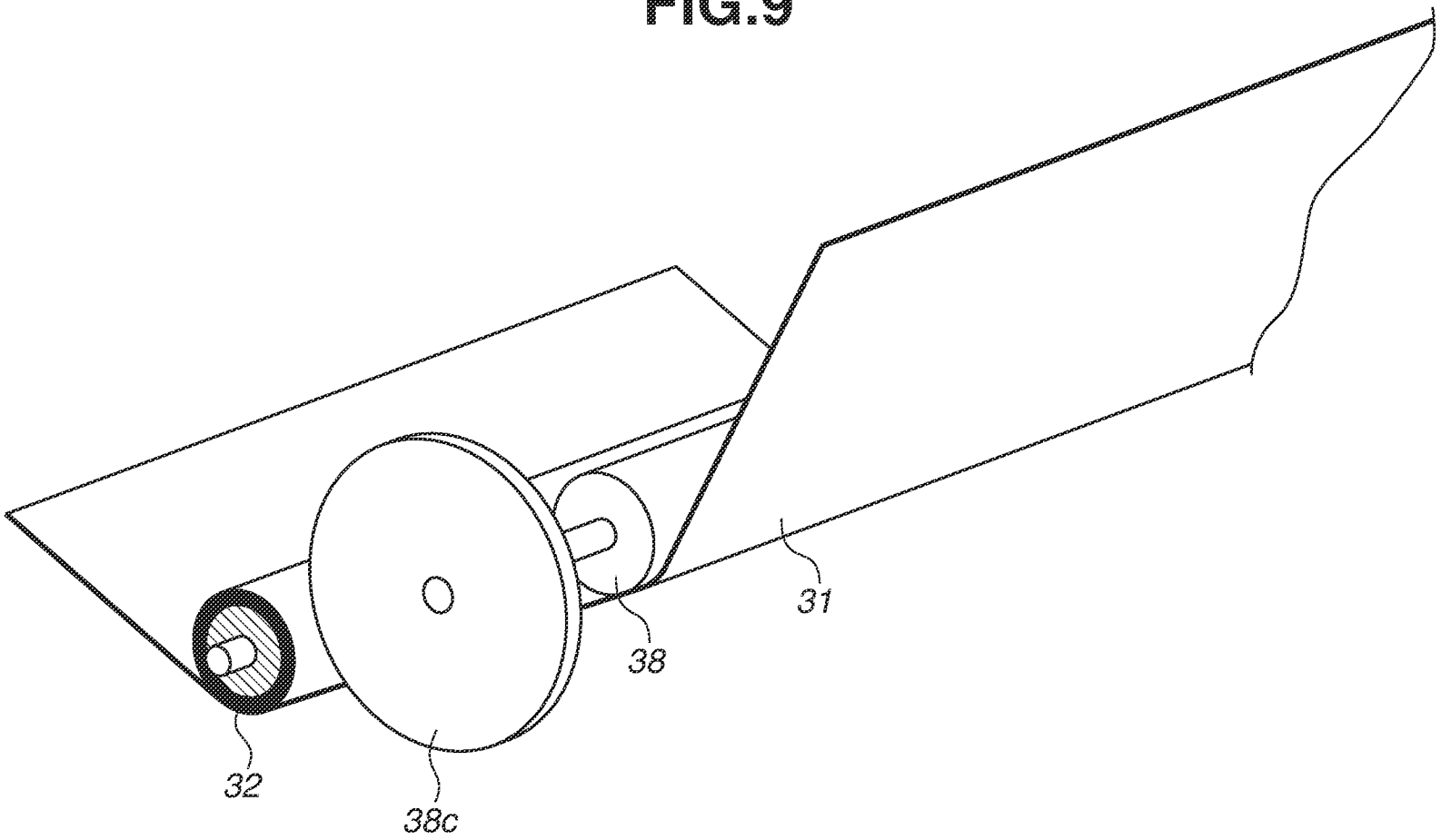
FIG. 9 is a schematic configuration view of a third exemplary embodiment.

In a third exemplary embodiment, the inertia roller 38 has a configuration that is different from the configurations thereof in the first and the second exemplary embodiments. Except this point, the third exemplary embodiment is the same as the first and the second exemplary embodiments. In each of the first and the second exemplary embodiments described above, one of the rollers by which the intermediate transfer belt 31 is stretched, itself, is configured to have a large moment of inertia. In the present exemplary embodiment, the roller part by which the intermediate transfer belt 31 is stretched has a small moment of inertia. Instead, as illustrated in FIG. 9, the inertia roller 38 is configured to provide a large moment of inertia by having a flywheel 38*c* attached to an end portion of the inertia roller 38. That is, in the present exemplary embodiment, the flywheel 38*c* is provided coaxially with the inertia roller 38. In this case, the moment of inertia of the roller part, which does not include the flywheel 38*c*, is not particularly limited. For example, the roller part can be a relatively lightweight roller such as an aluminum three-arrow-shaped tube.

The configurations according to the present disclosure can be used to provide an image forming apparatus for efficiently reducing velocity variations of an intermediate transfer belt thereof that occur when a printing medium enters a secondary transfer section thereof.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-189458, filed Oct. 4, 2018, which is hereby incorporated by reference herein in its entirety.

What is claimed is:

1. An image forming apparatus comprising:

an image forming unit configured to form an image;

an endless intermediate transfer belt, wherein an image formed in the image forming unit is to be primary transferred onto the endless intermediate transfer belt at a primary transfer portion and the image is to be secondary transferred from the endless intermediate transfer belt onto a recording material at a secondary transfer portion;

a transfer roller configured to contact an inner side of the endless intermediate transfer belt and to stretch the endless intermediate transfer belt at the secondary transfer portion;

a first roller configured to contact the inner side of the endless intermediate transfer belt and to stretch the endless intermediate transfer belt in a position downstream of the primary transfer portion and upstream of the secondary transfer portion in a moving direction of the endless intermediate transfer belt; and a second roller configured to contact the inner side of the endless intermediate transfer belt and to stretch the endless intermediate transfer belt in a position downstream of the first roller and upstream of the secondary transfer portion in the moving direction of the endless intermediate transfer belt, wherein the first roller has the largest wrap angle of the endless intermediate transfer belt among rollers stretching the endless intermediate transfer belt in a region downstream of the primary transfer portion and upstream of the secondary transfer portion in the moving direction of the endless intermediate transfer belt, wherein $L_1/L_2<1/2$ with $L_1$ denoting a length of a portion of the endless intermediate transfer belt that is stretched between the transfer roller and the second roller and $L_2$ denoting a length of a portion of the endless intermediate transfer belt that is stretched between the transfer roller and the first roller, and wherein the second roller has a moment of inertia of 30 $kgmm^2$ or more and 1500 $kgmm^2$ or less.

2. The image forming apparatus according to claim 1, wherein the second roller has a moment of inertia of 50 $kgmm^2$ or more and 1000 $kgmm^2$ or less.

3. The image forming apparatus according to claim 1, wherein a surface of the second roller has a static friction coefficient of 0.4 or more against an inner surface of the endless intermediate transfer belt.

4. The image forming apparatus according to claim 1, wherein the second roller is a roller that has an elastic layer provided on a surface thereof.

5. The image forming apparatus according to claim 1, wherein $L_1/L_2<1/3$.

6. The image forming apparatus according to claim 1, wherein $0<L_1<120$ mm.

7. The image forming apparatus according to claim 1, wherein the second roller includes a hollow and cylindrical base member made of iron.

8. The image forming apparatus according to claim 1, wherein the second roller has a moment of inertia of 30 $kgmm^2$ or more and 1500 $kgmm^2$ or less in a portion thereof positioned inside of the endless intermediate transfer belt in a rotational axis direction of the second roller.

9. An image forming apparatus comprising:

an image forming unit configured to form an image;

an endless intermediate transfer belt, wherein an image formed in the image forming unit is to be primary transferred onto the endless intermediate transfer belt at a primary transfer portion and the image is to be secondary transferred from the endless intermediate transfer belt onto a recording material at a secondary transfer portion;

a transfer roller configured to contact an inner side of the endless intermediate transfer belt and to stretch the endless intermediate transfer belt at the secondary transfer portion;

a first roller configured to contact the inner side of the endless intermediate transfer belt and to stretch the endless intermediate transfer belt in a position downstream of the primary transfer portion and upstream of the secondary transfer portion in a moving direction of the endless intermediate transfer belt;

a second roller configured to contact the inner side of the endless intermediate transfer belt and to stretch the endless intermediate transfer belt in a position downstream of the first roller and upstream of the secondary transfer portion in the moving direction of the endless intermediate transfer belt; and a flywheel attached to the second roller, wherein the first roller has the largest wrap angle of the endless intermediate transfer belt among rollers stretching the endless intermediate transfer belt in a region downstream of the primary transfer portion and upstream of the secondary transfer portion in the moving direction of the endless intermediate transfer belt, wherein $L_1/L_2<1/2$ with $L_1$ denoting a length of a portion of the endless intermediate transfer belt that is stretched between the transfer roller and the second roller and $L_2$ denoting a length of a portion of the endless intermediate transfer belt that is stretched between the transfer roller and the first roller, and wherein the second roller with the attached flywheel has a moment of inertia of 30 $kgmm^2$ or more and 1500 $kgmm^2$ or less.

10. The image forming apparatus according to claim 9, wherein $L_1/L_2<1/3$.

11. The image forming apparatus according to claim 9, wherein $0<L_1<120$ mm.

* * * * *